US008234795B2

(12) United States Patent
Dull et al.

(10) Patent No.: US 8,234,795 B2
(45) Date of Patent: Aug. 7, 2012

(54) VERTICAL DRUM DRIER

(75) Inventors: Bob Jay Dull, Akron, OH (US); Jerry Lynn Crawford, Salinas, CA (US); Frank Edward Davis, Oak Brook, IL (US); Jose Emilio Villarreal Lozoya, Monterey, CA (US); Yuki Mikoshiba, Salinas, CA (US)

(73) Assignee: Dole Fresh Vegetables, Inc., Monterey, CA (US)

( * ) Notice: Subject to any disclaimer, the term of this patent is extended or adjusted under 35 U.S.C. 154(b) by 326 days.

(21) Appl. No.: 12/511,966

(22) Filed: Jul. 29, 2009

(65) Prior Publication Data

US 2011/0023320 A1 Feb. 3, 2011

(51) Int. Cl.
*F26B 5/08* (2006.01)

(52) U.S. Cl. ..... 34/312; 34/317; 34/318; 34/322; 34/58; 34/128

(58) Field of Classification Search ..... 34/312, 34/314, 317, 318, 319, 322, 58, 127, 128; 426/443, 465, 472
See application file for complete search history.

(56) References Cited

U.S. PATENT DOCUMENTS 2,784,500 A 3/1957 Beaumont
5,966,830 A 10/1999 Schnacke
6,473,988 B1 * 11/2002 Mulhauser et al. ..... 34/58
7,028,415 B2 4/2006 Heinzen et al.
7,111,546 B2 * 9/2006 Siegel et al. ..... 34/58

FOREIGN PATENT DOCUMENTS

FR 2608463 A1 6/1988

OTHER PUBLICATIONS

International Search Report and Written Opinion received for PCT Patent Application No. PCT/US2010/043782, mailed on Oct. 5, 2010, 7 pages.
International Preliminary Report on Patentability received for PCT Patent Application No. PCT/US2010/043782, mailed on Feb. 9, 2012, 6 pages.

* cited by examiner

*Primary Examiner* — Jiping Lu
(74) *Attorney, Agent, or Firm* — Morrison & Foerster LLP

(57) ABSTRACT

A method and apparatus for drying produce in a centrifugal drier is described. The drier includes a housing and a drum configured to receive a multi-volume basket. The method includes loading produce into a first volume and a second volume of the multi-volume basket. The basket may include perforated walls, a closed lower end, and an open upper end. The interior volume of the basket is divided into at least a first volume and a second volume by a perforated inner divider that is oriented concentrically to the basket walls. The first volume is disposed inside the inner divider. The second volume is disposed between the inner divider and the basket walls. A drive assembly rotates the drum and the basket, loaded with produce in the first and second volumes, to cause fluids to drain out of the produce to yield dried produce.

18 Claims, 14 Drawing Sheets

*Fig. 6*

SUMMARY OF DEWATERING EXPERIMENTS
Dole Fresh Vegetables, Soledad, CA / January and February, 2009

Romaine Lettuce Trials

| Test | | Residual Moisture | Note |
|---|---|---|---|
| Fresh washed Romaine | | 8.50% | |
| Single-volume SD-50/1 spin | | 3.20% | a |
| Single-volume SD-50/2 spins | | 2.90% | a |
| Multi-volume SD-50/1 spin | | | b |
| | Inside Barrel | 1.20% | |
| | Outside Barrel | 1.90% | |
| Multi-volume SD-50/2 spins | | | b |
| | Inside Barrel | 1.10% | |
| | Outside Barrel | 1.70% | |

Spring Mix Trials

| Test | | Residual Moisture | |
|---|---|---|---|
| Fresh washed Spring Mix | | 23.50% | c |
| Single-volume SD-50/1 spin | | 4.90% | a |
| Single-volume SD-50/2 spins | | 4.50% | a |
| Multi-volume SD-50/1 spin | | | b |
| | Inside Barrel | 2.40% | |
| | Outside Barrel | 2.90% | |
| Multi-volume SD-50/2 spins | | | b |
| | Inside barrel | 2.30% | |
| | Outside Barrel | 2.70% | |

a=single-volume with standard spin cycle
b=multi-volume basket with standard spin cycle
c=23% drip also seen within 3-5 minutes after collection

Fig. 7A

| PRODUCT | DRYER | LOCATION | Sample Weight (g) | 1st Moisture (g) | 2nd Moisture (g) | Final Moisture (g) | % Moisture | % Moisture Average | % Moisture Removal from Wet Product | Note |
|---|---|---|---|---|---|---|---|---|---|---|
| CHOPPED ROMAINE | SINGLE DRUM | WET SAMPLE | 200 | 173 | 170 | 168 | 16.00% | 18.64% | | 2/18/2009 |
| | | WET SAMPLE | 171 | | 135 | 135 | 21.05% | | | 20 minutes dry |
| | | WET SAMPLE | 175 | | 142 | 142 | 18.86% | | | |
| | SINGLE DRUM | AFTER DRY | 150 | 143 | 139 | 139 | 7.33% | 7.67% | 58.82% | 2/18/2009 |
| | | AFTER DRY | 151 | 142 | 139 | 139 | 7.95% | | | 15 minutes dry |
| | | AFTER DRY | 155 | | 143 | 143 | 7.74% | | | |
| | DOUBLE DRUM | AFTER DRY INSIDE | 151 | | 141 | 141 | 6.62% | 6.27% | 66.37% | 2/18/2009 |
| | | AFTER DRY INSIDE | 156 | | 145 | 145 | 7.05% | | | 15 minutes dry |
| | | AFTER DRY INSIDE | 156 | | 148 | 148 | 5.13% | | | |
| | DOUBLE DRUM | AFTER DRY OUTSIDE | 162 | | 150 | 150 | 7.41% | 5.79% | 68.93% | 2/18/2009 |
| | | AFTER DRY OUTSIDE | 166 | | 158 | 158 | 4.82% | | | 15 minutes dry |
| | | AFTER DRY OUTSIDE | 175 | | 166 | 166 | 5.14% | | | |
| CLASSIC ICEBERG (1st Trial) | SINGLE DRUM | WET SAMPLE | 200 | | 146 | 146 | 27.00% | 27.21% | | 2/18/2009 |
| | | WET SAMPLE | 199 | | 144 | 144 | 27.64% | | | 30 minutes dry |
| | | WET SAMPLE | 200 | | 146 | 146 | 27.00% | | | |
| | SINGLE DRUM | AFTER DRY | 198 | 181 | 176 | 176 | 11.11% | 10.67% | 60.78% | 2/18/2009 |
| | | AFTER DRY | 176 | 164 | 156 | 156 | 11.36% | | | 15 minutes dry |
| | | AFTER DRY | 199 | | 180 | 180 | 9.55% | | | |
| | DOUBLE DRUM | AFTER DRY INSIDE | 199 | | 178 | 178 | 10.55% | 11.54% | 57.60% | 2/18/2009 |
| | | AFTER DRY INSIDE | 200 | | 176 | 176 | 12.00% | | | 15 minutes dry |
| | | AFTER DRY INSIDE | 199 | | 175 | 175 | 12.06% | | | |
| | DOUBLE DRUM | AFTER DRY OUTSIDE | 201 | | 178 | 178 | 11.44% | 10.83% | 60.19% | 2/18/2009 |
| | | AFTER DRY OUTSIDE | 199 | | 177 | 177 | 11.06% | | | 15 minutes dry |
| | | AFTER DRY OUTSIDE | 200 | | 180 | 180 | 10.00% | | | |

Fig. 7B

| PRODUCT | DRYER | LOCATION | Sample Weight (g) | 1st Moisture (g) | 2nd Moisture (g) | Final Moisture (g) | % Moisture | % Moisture Average | % Moisture Removal from Wet Product | Note |
|---|---|---|---|---|---|---|---|---|---|---|
| CLASSIC ICEBERG (2nd Trial) | SINGLE DRUM | WET SAMPLE | 200 | | 155 | 155 | 22.50% | 22.27% | | 2/19/2009 |
| | | WET SAMPLE | 206 | | 159 | 159 | 22.82% | | | 20 minutes dry |
| | | WET SAMPLE | 200 | | 157 | 157 | 21.50% | | | |
| | SINGLE DRUM | AFTER DRY | 200 | | 184 | 184 | 8.00% | 9.17% | 58.84% | 2/19/2009 |
| | | AFTER DRY | 200 | | 180 | 180 | 10.00% | | | 10 minutes dry |
| | | AFTER DRY | 200 | | 181 | 181 | 9.50% | | | |
| | DOUBLE DRUM | AFTER DRY INSIDE | 197 | | 178 | 178 | 9.64% | 9.74% | 56.28% | 2/19/2009 |
| | | AFTER DRY INSIDE | 200 | | 180 | 180 | 10.00% | | | 10 minutes dry |
| | | AFTER DRY INSIDE | 209 | | 189 | 189 | 9.57% | | | |
| | DOUBLE DRUM | AFTER DRY OUTSIDE | 200 | | 184 | 184 | 8.00% | 8.61% | 61.32% | 2/19/2009 |
| | | AFTER DRY OUTSIDE | 199 | | 183 | 183 | 8.04% | | | 10 minutes dry |
| | | AFTER DRY OUTSIDE | 204 | | 184 | 184 | 9.80% | | | |
| SHREDDED ICEBERG | SINGLE DRUM | WET SAMPLE | 200 | 163 | 142 | 135 | 29.00% | 27.26% | | 2/20/2009 |
| | | WET SAMPLE | 208 | | 159 | 159 | 23.56% | | | 15 minutes dry |
| | | WET SAMPLE | 202 | | 143 | 143 | 29.21% | | | |
| | SINGLE DRUM | AFTER DRY | 201 | | 179 | 179 | 10.95% | 10.43% | 61.73% | 2/20/2009 |
| | | AFTER DRY | 201 | | 181 | 181 | 9.95% | | | 5 minutes dry |
| | | AFTER DRY | 202 | | 181 | 181 | 10.40% | | | |
| | DOUBLE DRUM | AFTER DRY INSIDE | 200 | | 184 | 184 | 8.00% | 9.43% | 65.39% | 2/20/2009 |
| | | AFTER DRY INSIDE | 202 | | 183 | 183 | 9.41% | | | 5 minutes dry |
| | | AFTER DRY INSIDE | 202 | | 180 | 180 | 10.89% | | | |
| | DOUBLE DRUM | AFTER DRY OUTSIDE | 203 | | 183 | 183 | 9.85% | 9.24% | 66.10% | 2/20/2009 |
| | | AFTER DRY OUTSIDE | 202 | | 184 | 184 | 8.91% | | | 5 minutes dry |
| | | AFTER DRY OUTSIDE | 201 | | 183 | 183 | 8.96% | | | |

Fig. 7C

| PRODUCT | DRYER | LOCATION | Sample Weight (g) | 1st Moisture (g) | 2nd Moisture (g) | Final Moisture (g) | % Moisture | % Moisture Average | % Moisture Removal from Wet Product | Note |
|---|---|---|---|---|---|---|---|---|---|---|
| COLESLAW | SINGLE DRUM | WET SAMPLE | 200 | 163 | 139 | 139 | 30.50% | 30.83% | | 2/18/09 run, 2/19/09 |
| | | WET SAMPLE | 200 | 174 | 137 | 137 | 31.50% | | | 20 minutes dry |
| | | WET SAMPLE | 200 | | 139 | 139 | 30.50% | | | |
| | SINGLE DRUM | AFTER DRY | 200 | 183 | 170 | 170 | 15.00% | 15.69% | 49.11% | 2/18/09 run, 2/19/09 |
| | | AFTER DRY | 200 | | 164 | 164 | 18.00% | | | 10 minutes dry |
| | | AFTER DRY | 199 | | 171 | 171 | 14.07% | | | |
| | DOUBLE DRUM | AFTER DRY INSIDE | 200 | | 167 | 167 | 16.50% | 15.72% | 49.02% | 2/18/09 run, 2/19/09 |
| | | AFTER DRY INSIDE | 199 | | 167 | 167 | 16.08% | | | 10 minutes dry |
| | | AFTER DRY INSIDE | 199 | | 170 | 170 | 14.57% | | | |
| | DOUBLE DRUM | AFTER DRY OUTSIDE | 200 | | 164 | 164 | 18.00% | 16.36% | 46.94% | 2/18/09 run, 2/19/09 |
| | | AFTER DRY OUTSIDE | 200 | | 169 | 169 | 15.50% | | | 10 minutes dry |
| | | AFTER DRY OUTSIDE | 199 | | 168 | 168 | 15.58% | | | |
| EUROPEAN (Iceberg, Romaine, Red Leaf, Radicchio & Frisee) | SINGLE DRUM | WET SAMPLE | 152 | | 126 | 126 | 17.11% | 17.26% | | 2/20/2009 |
| | | WET SAMPLE | 155 | | 128 | 128 | 17.42% | | | 20 minutes dry |
| | SINGLE DRUM | AFTER DRY | 151 | | 141 | 141 | 6.62% | 7.35% | 57.43% | 2/20/2009 |
| | | AFTER DRY | 154 | | 143 | 143 | 7.14% | | | 10 minutes dry |
| | | AFTER DRY | 157 | | 144 | 144 | 8.28% | | | |
| | DOUBLE DRUM | AFTER DRY INSIDE | 156 | 149 | 145 | 145 | 7.05% | 7.05% | 59.15% | 2/20/2009 |
| | | AFTER DRY INSIDE | 155 | | 144 | 144 | 7.10% | | | 10 minutes dry |
| | | AFTER DRY INSIDE | 157 | | 146 | 146 | 7.01% | | | |
| | DOUBLE DRUM | AFTER DRY OUTSIDE | 157 | | 146 | 146 | 7.01% | 6.36% | 63.17% | 2/20/2009 |
| | | AFTER DRY OUTSIDE | 157 | | 147 | 147 | 6.37% | | | 10 minutes dry |
| | | AFTER DRY OUTSIDE | 158 | | 149 | 149 | 5.70% | | | |

Fig. 7D

| PRODUCT | DRYER | LOCATION | Sample Weight (g) | 1st Moisture (g) | 2nd Moisture (g) | Final Moisture (g) | % Moisture | % Moisture Average | % Moisture Removal from Wet Product | Note |
|---|---|---|---|---|---|---|---|---|---|---|
| GREENER SELECTION | SINGLE DRUM | WET SAMPLE | 200 | 181 | 170 | 170 | 15.00% | 17.80% | | 2/19/2009 |
| | | WET SAMPLE | 200 | | 162 | 162 | 19.00% | | | 20 minutes dry |
| | | WET SAMPLE | 201 | | 162 | 162 | 19.40% | | | |
| | SINGLE DRUM | AFTER DRY | 200 | | 181 | 181 | 9.50% | 8.67% | 51.31% | 2/19/2009 |
| | | AFTER DRY | 199 | | 182 | 182 | 8.54% | | | 10 minutes dry |
| | | AFTER DRY | 201 | | 185 | 185 | 7.96% | | | |
| | DOUBLE DRUM | AFTER DRY INSIDE | 200 | | 185 | 185 | 7.50% | 7.37% | 58.59% | 2/19/2009 |
| | | AFTER DRY INSIDE | 198 | | 182 | 182 | 8.08% | | | 10 minutes dry |
| | | AFTER DRY INSIDE | 199 | | 186 | 186 | 6.53% | | | |
| | DOUBLE DRUM | AFTER DRY OUTSIDE | 200 | | 184 | 184 | 8.00% | 7.50% | 57.87% | 2/19/2009 |
| | | AFTER DRY OUTSIDE | 200 | | 186 | 186 | 7.00% | | | 10 minutes dry |
| | | AFTER DRY OUTSIDE | 200 | | 185 | 185 | 7.50% | | | |

*Fig. 8A*

| PRODUCT | DRYER | LOCATION | % Moisture Average | % Moisture Removal from Wet Product |
|---|---|---|---|---|
| CHOPPED ROMAINE | SINGLE DRUM | WET SAMPLE | 18.64% | |
| | SINGLE DRUM | AFTER DRY | 7.67% | 58.82% |
| | DOUBLE DRUM | AFTER DRY INSIDE | 6.27% | 66.37% |
| | DOUBLE DRUM | AFTER DRY OUTSIDE | 5.79% | 68.93% |
| CLASSIC ICEBERG | SINGLE DRUM | WET SAMPLE | 22.27% | |
| | | WET SAMPLE | | |
| | | WET SAMPLE | | |
| | SINGLE DRUM | AFTER DRY | 9.17% | 58.84% |
| | | AFTER DRY | | |
| | | AFTER DRY | | |
| | DOUBLE DRUM | AFTER DRY INSIDE | 9.74% | 56.28% |
| | | AFTER DRY INSIDE | | |
| | | AFTER DRY INSIDE | | |
| | DOUBLE DRUM | AFTER DRY OUTSIDE | 8.61% | 61.32% |
| | | AFTER DRY OUTSIDE | | |
| | | AFTER DRY OUTSIDE | | |
| SHREDDED ICEBERG | SINGLE DRUM | WET SAMPLE | 27.26% | |
| | | WET SAMPLE | | |
| | | WET SAMPLE | | |
| | SINGLE DRUM | AFTER DRY | 10.43% | 61.73% |
| | | AFTER DRY | | |
| | | AFTER DRY | | |
| | DOUBLE DRUM | AFTER DRY INSIDE | 9.43% | 65.39% |
| | | AFTER DRY INSIDE | | |
| | | AFTER DRY INSIDE | | |
| | DOUBLE DRUM | AFTER DRY OUTSIDE | 9.24% | 66.10% |
| | | AFTER DRY OUTSIDE | | |
| | | AFTER DRY OUTSIDE | | |
| COLESLAW | SINGLE DRUM | WET SAMPLE | 30.83% | |
| | | WET SAMPLE | | |
| | | WET SAMPLE | | |
| | SINGLE DRUM | AFTER DRY | 15.69% | 49.11% |
| | | AFTER DRY | | |
| | | AFTER DRY | | |
| | DOUBLE DRUM | AFTER DRY INSIDE | 15.72% | 49.02% |
| | | AFTER DRY INSIDE | | |
| | | AFTER DRY INSIDE | | |
| | DOUBLE DRUM | AFTER DRY OUTSIDE | 16.36% | 46.94% |
| | | AFTER DRY OUTSIDE | | |
| | | AFTER DRY OUTSIDE | | |

*Fig. 8B*

| | | | | |
|---|---|---|---|---|
| EUROPEAN BLEND | SINGLE DRUM | WET SAMPLE | 17.26% | |
| | | WET SAMPLE | | |
| | | WET SAMPLE | | |
| | SINGLE DRUM | AFTER DRY | 7.35% | 57.43% |
| | | AFTER DRY | | |
| | | AFTER DRY | | |
| | DOUBLE DRUM | AFTER DRY INSIDE | 7.05% | 59.15% |
| | | AFTER DRY INSIDE | | |
| | | AFTER DRY INSIDE | | |
| | DOUBLE DRUM | AFTER DRY OUTSIDE | 6.36% | 63.17% |
| | | AFTER DRY OUTSIDE | | |
| | | AFTER DRY OUTSIDE | | |
| GREENER SELECTION | SINGLE DRUM | WET SAMPLE | 17.80% | |
| | | WET SAMPLE | | |
| | | WET SAMPLE | | |
| | SINGLE DRUM | AFTER DRY | 8.67% | 51.31% |
| | | AFTER DRY | | |
| | | AFTER DRY | | |
| | DOUBLE DRUM | AFTER DRY INSIDE | 7.37% | 58.59% |
| | | AFTER DRY INSIDE | | |
| | | AFTER DRY INSIDE | | |
| | DOUBLE DRUM | AFTER DRY OUTSIDE | 7.50% | 57.87% |
| | | AFTER DRY OUTSIDE | | |
| | | AFTER DRY OUTSIDE | | |

VERTICAL DRUM DRIER

BACKGROUND

1. Field

The present disclosure relates generally to commercial drying of produce; more specifically, it relates to removal of surface liquids from produce, including but not limited to leafy vegetables, using vertical or canted drum centrifugal driers.

2. Related Art

The commercial processing of fresh produce requires that once harvested, it be washed clean followed by sanitizing to provide a safe product with a useful shelf-life. In order to accomplish this cleaning and sanitizing, large volumes of water are used to provide mechanical cleaning while also being used to carry cleaners and sanitizers, like chlorine. While this results in a clean and sanitary product, the water added must be separated from the produce and either be sent to drain, recycled, or further processed for disposal.

Moisture that remains on the produce after packaging has a negative impact on shelf-life and product appeal. The amount of moisture can vary for many reasons including the product mix, piece sizes, time of year, and other factors. The removal of residual water from the surfaces of fresh, packaged produce is an important process for extending the shelf-life and maintaining the aesthetic appeal of the product after packaging. It is desired that the product be as dry as possible without causing dehydration of the leaves.

Drying can be accomplished in many ways: fluidized bed drying, spiral coolers, horizontal and vertical/canted drum drying, infrared, and many others. During processing, fresh vegetables are preferably maintained at or slightly below 4° C. This preference has commonly resulted in the use of centrifugal drum driers to both dewater and dry the product after washing and sanitation of the product. This preference has also led to less than successful or inconsistent removal of this surface water. During centrifugal drying, the produce is compacted by the weight of the produce on top of it and by the centrifugal force created by the dryer. This compaction of the produce and the resulting increased density of the produce are referred to as matting. Matting contributes to the problem of inconsistent drying and also causes bruising of the produce. As a spin cycle in a conventional centrifugal dryer nears completion, the produce is denser near the bottom and outer parts of the basket, and less dense near the top and inner parts of the basket. Since the produce becomes more difficult to dry as its density increases, the produce near the top of the basket is drier at the end of a spin cycle than the produce near the bottom of the basket. Inconsistent drying has an adverse impact on the quality of the product.

What is needed are processes and devices to dry produce thoroughly and consistently while minimizing drying cycle time and damage to the produce.

SUMMARY

A process for drying of produce, particularly suited to drying leafy vegetables, is described herein. The process employs a multi-volume basket apparatus that allows for the removal of additional water at a given rotational speed and duration of a drying cycle, as compared to a process using a single-volume basket. This results in improved shelf-life of the products and greater aesthetic appeal of the products due to enhanced water removal and minimized damage to the produce.

DESCRIPTION OF DRAWING FIGURES

FIGS. 6, 7A-7D, 8A-8B, 9, and 10 summarize experimental data obtained during testing of the process and apparatus.

DETAILED DESCRIPTION

The following description sets forth exemplary drying processes, parameters, and the like. It should be recognized, however, that such description is not intended as a limitation on the scope of the present proposed invention but is instead provided as a description of exemplary embodiments.

A commercial process for drying produce including but not limited to leafy vegetables in a centrifugal drier and a multi-volume basket apparatus for use in the drying process are set forth below.

1. Drier

Figure 1:
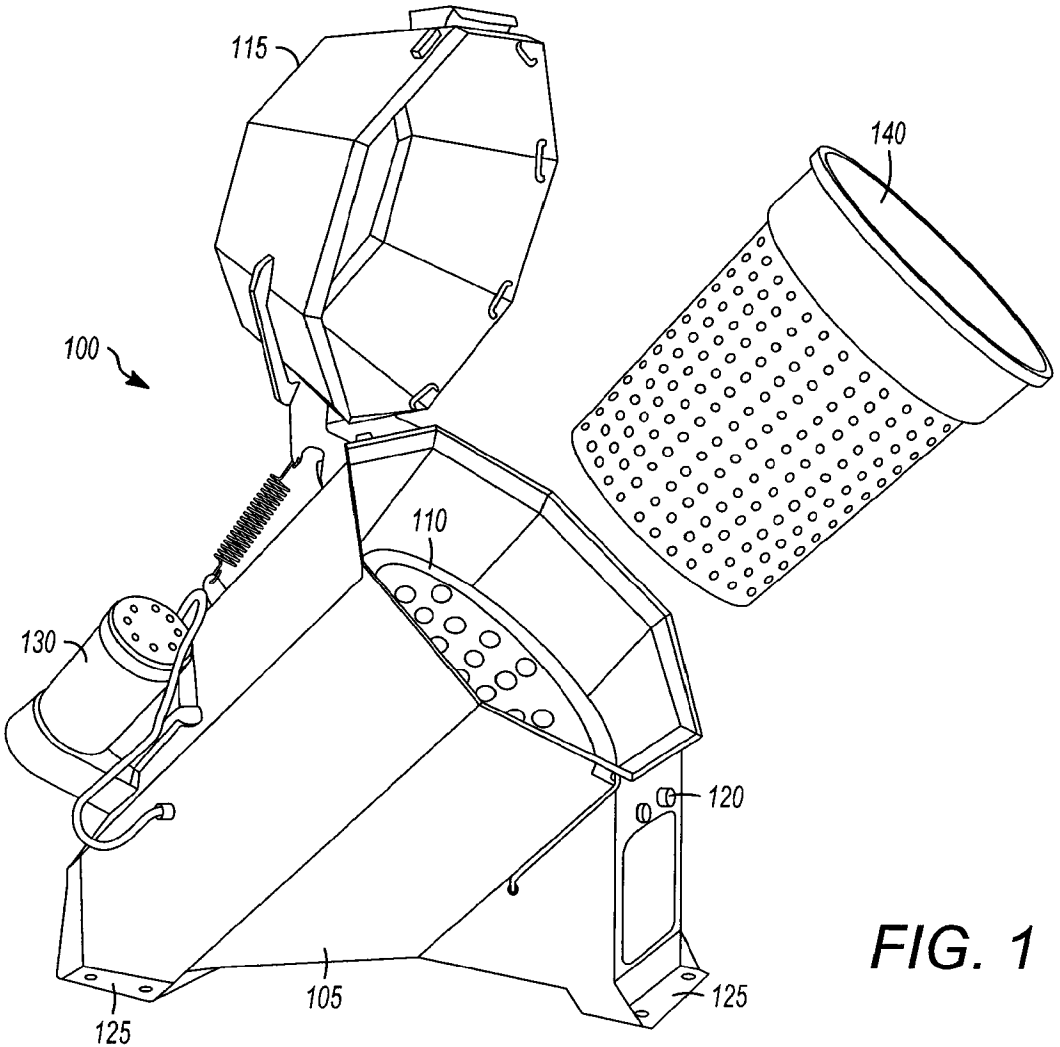
FIG. 1 shows a side view of an example of a centrifugal drier that may be used for drying produce.

Vertical or canted drum centrifugal driers are commonly used for drying produce during processing and prior to packaging. FIG. 1 shows an example of a canted drum centrifugal drier that is used for commercial drying of produce. The exemplary drier shown in FIG. 1 is similar to those described in U.S. Pat. No. 7,028,415 by Heinzen et al. The drier shown in FIG. 1 is suitable for use with the drying process and basket apparatus set forth herein. Other centrifugal driers of different design may also be used.

The drier 100 shown in FIG. 1 comprises a housing 105 containing a drive assembly (not shown) and a drum 110 for holding a produce basket. A hinged lid 115 is coupled to the housing for opening and closing the drier. A control system for controlling the drive assembly (not shown) includes a start button 120. The housing 105 includes footings 125 that are coupled to the floor of the facility in which the drier 100 is used to prevent the drier 100 from moving during operation. The drum of the drier may be canted at an angle from vertical to ease loading. The housing is equipped with a drain (not shown) to allow water that is removed from the produce and collected within the housing 105 to drain to an outlet hose or pipe or onto the floor. In the example shown in FIG. 1 the drum 110 is cylindrical, but other shapes may be used in alternative variations. The drum 110 is mounted on a drive shaft (not shown) that is attached to a drive assembly and thereby connected to the motor 130 that is used to rotate the drum 110. The drum 110 is configured to receive a removable basket 140 that holds the produce. The drum 110 and basket 140 are configured so that when the basket 140 is placed into the drum, it seats securely in the drum so that rotation of the drum causes rotation of the basket.

While not required, driers such as those of FIG. 1 may be modified to include fan blades or compressed air for increasing air flow through the drier.

2. Basket

Cylindrical baskets for holding produce are commonly used with the type of vertical or canted drum centrifugal drier described above. The commonly used baskets typically have a single interior volume defined by the bottom and the side walls of the basket.

Dividing the interior volume of a cylindrical basket into multiple, concentric volumes separated by a perforated divider allows more water to be removed from produce at a given rotational speed and drying cycle duration, as compared to a process using a single-volume basket. Using a multi-volume basket reduces matting and results in longer shelf-life of the produce, greater aesthetic appeal of the produce, less damage to the produce, and more consistent drying.

Figure 2:
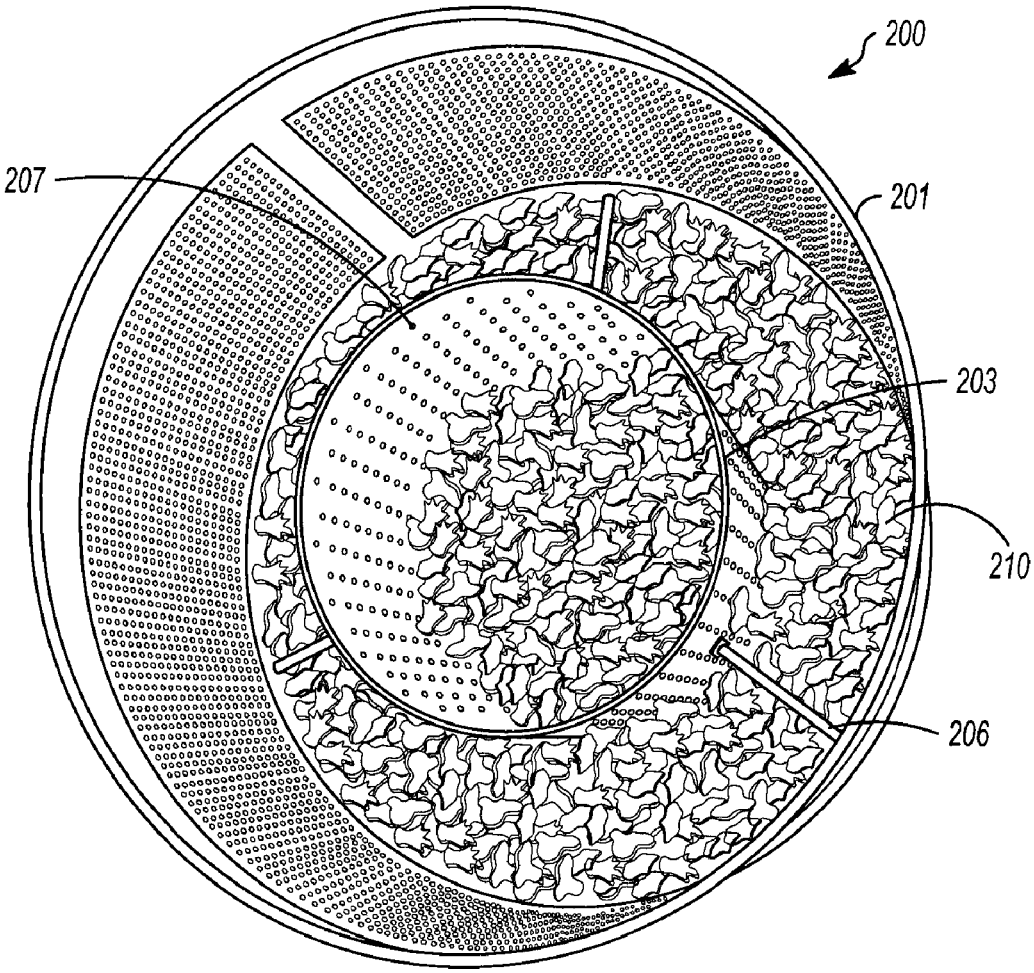
FIG. 2 shows a top perspective view of an exemplary multi-volume basket.

FIG. 2 shows an example of a multi-volume cylindrical basket 200 for holding produce that may be used with the drier described above in the process set forth herein. In other variations, the multi-volume basket may be another shape including but not limited to a cube or rectangular solid. The basket 200 shown in FIG. 2 has perforated walls 201 defining the sides of the basket and a closed, perforated bottom. In other variations, the bottom may not be perforated. The top of the basket is open for loading and unloading produce. The perforations 207 are sized so as to be large enough to allow fluid to easily exit the basket, but small enough to contain the produce in the basket. Therefore, the size of the perforations may vary depending on many factors including the type of produce being dried.

The basket 200 in this example is constructed of stainless steel. In other variations, the basket may be constructed of any food-grade material such as metal, plastic, composite, other material, or a combination of materials.

The multi-volume basket shown in FIG. 2 has one perforated, cylindrical divider 203 that is oriented concentrically to the walls of the basket. The height of the divider in this example is less than the height of the walls. The ratio of the height of the divider to the height of the walls in this example is approximately 90%. In other variations, this ratio may vary from 50-100%. As the ratio is increased, drying is improved. However, higher ratios tend to cause balance problems during the spin cycle. Thus, this ratio is selected with the goal of maximizing the height of the divider while maintaining acceptable balance. A first volume is defined by the interior of the cylindrical divider and includes the center of the basket. A second volume is disposed between the divider and the walls of the basket. In some variations, such as in this example, where the height of the divider is less than the height of the walls, a third volume at the top of the basket is defined by the basket walls, the horizontal plane defining the top of the basket, and the horizontal plane defining the top of the divider. Produce is typically loaded into the basket to a level at or near the top of the walls of the basket. In some variations, produce may be loaded to a lower level. In the example shown in FIG. 2, the basket 200 is partially filled with chopped lettuce 210.

The cylindrical divider 203 in this example has a diameter that is approximately 70% of the diameter of the walls of the basket. In other variations, the ratio of the diameter of the divider to the diameter of the walls may range from 20-80% or the divider may be another shape.

The volume defined by the cylindrical divider in the example of FIG. 2 is approximately 45% of the volume of the entire basket in this example. In other variations, the ratio of the volume defined by the cylindrical divider to the volume of the entire basket may range from 25-85%. In other variations, one or more additional dividers may be used to further subdivide the interior of the basket. The ratio and the number of dividers are selected so as to optimally subdivide the volume of the basket to maximize drying and consistency of drying while maintaining sufficient annular spaces to provide for ease of loading, balancing, unloading, and cleaning the basket.

The divider in this example is attached to the bottom of the basket by welded brackets (not shown). The divider is secured to the walls by three welded steel support rods 206 which run radially from the outside surface of the inner divider to the inside surface of the walls of the basket. In other variations, fewer or more support rods may be used. The support rods in this example are attached at approximately the midpoint of the height of the walls and run perpendicular to the bottom of the basket. In other variations, the divider may be attached at another height, or may be attached to the bottom and/or walls of the basket by other means. In other variations, the divider may itself have a bottom, thereby being a basket within a basket.

Figure 3A:
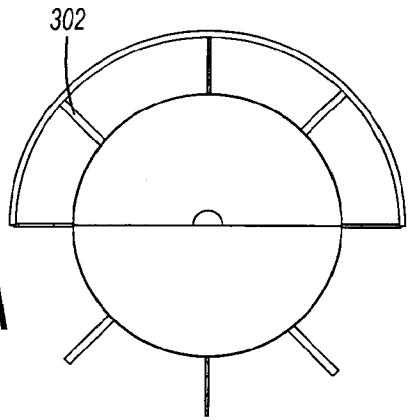
FIG. 3A shows a top view of an exemplary multi-volume basket.
Figure 3B:
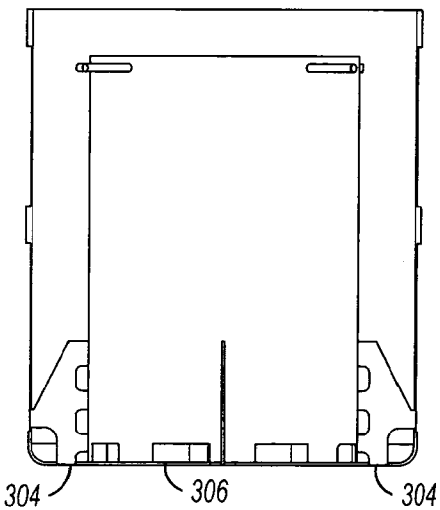
FIG. 3B shows a side view of an exemplary multi-volume basket.
Figure 3C:
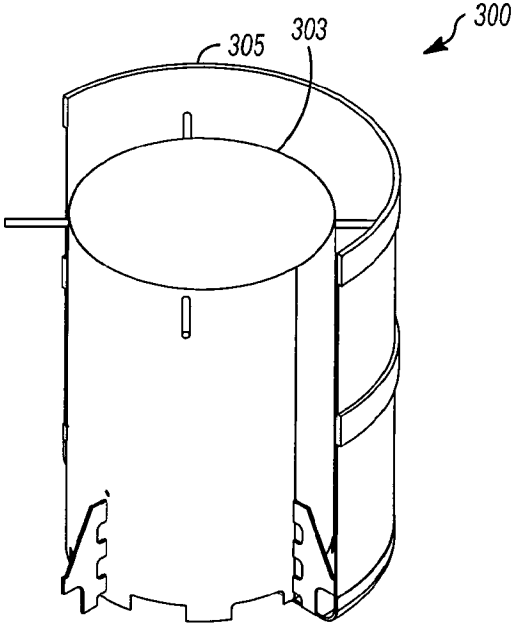
FIG. 3C shows a perspective cutaway view of an exemplary multi-volume basket.

FIGS. 3A, 3B, and 3C show another example of a multi-volume basket 300. The basket 300 is similar to the basket 200 shown in FIG. 2, except the basket 300 in this example is equipped with four support rods 302 instead of three and the basket 300 also uses a different type of bracket 304 to attach the divider 303 to the basket walls 305 and the bottom of the basket 306.

Figure 4:
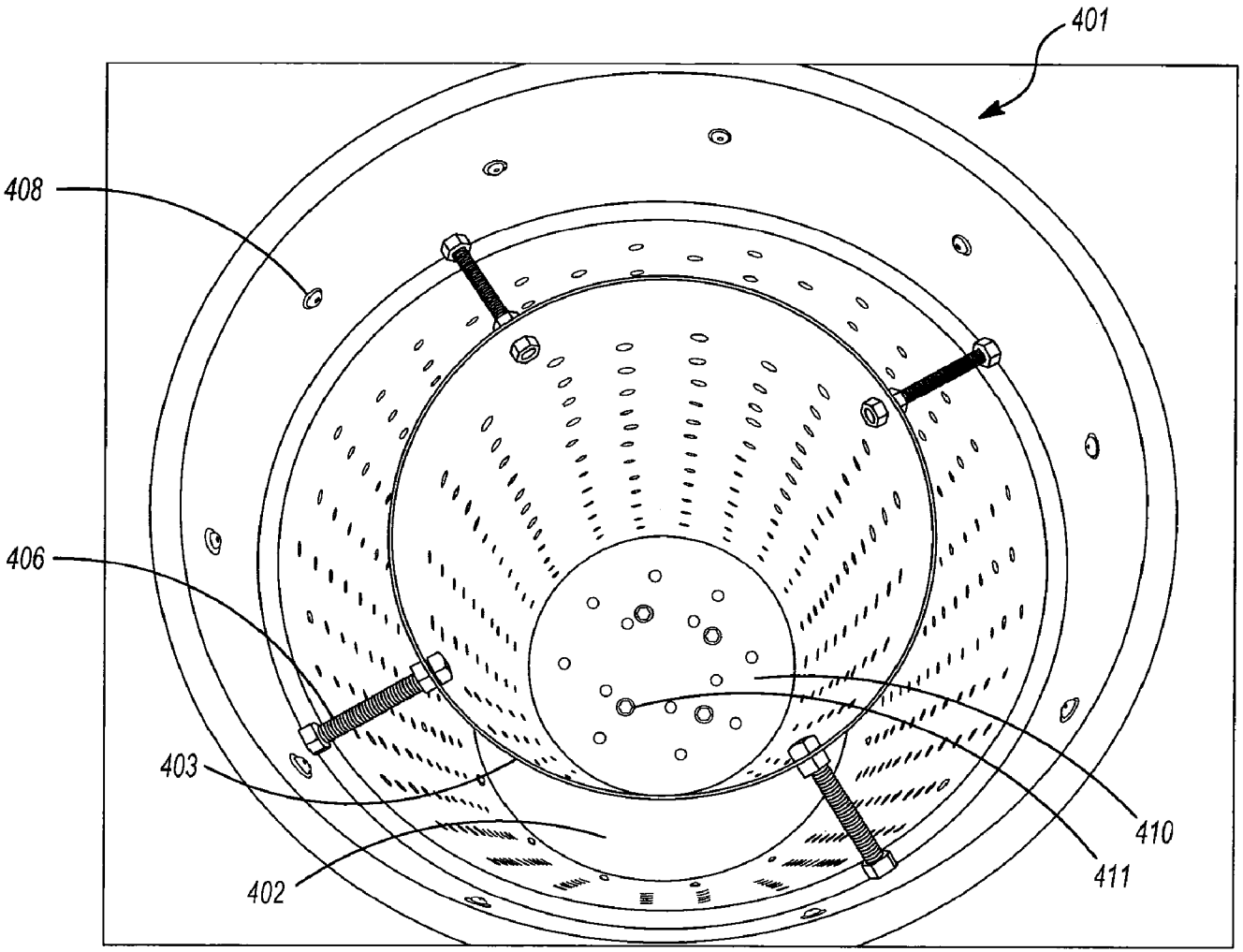
FIG. 4 shows a top perspective view of an exemplary multi-volume basket.

FIG. 4 shows another example of a multi-volume basket 400. The basket walls 401, bottom 402, and divider 403 in this example are constructed of polypropylene. In other variations, the basket may be constructed of any food-grade material such as metal, plastic, composite, other material, or a combination of materials. The basket walls 401 and divider 403 are perforated. In this example, the divider 403 includes a perforated bottom 410 that is attached to the basket bottom 402 with nuts and bolts 411 and is flush with the basket bottom. The divider 403 is attached to the walls 401 of the basket by nuts and bolts 406 which serve as support rods and are attached near the top of the walls rather than near the midpoint of the walls. In this example, a metal band (not shown) is attached around the circumference of the outside upper edge of the walls 401 using nuts and bolts 408. In this example, another metal band (not shown) is attached around the circumference of the outside upper edge of the walls of the divider 403. These additions reinforce the basket walls 401 and divider 403 to prevent warping of the polypropylene basket during high acceleration and/or when the load is imbalanced or uneven. In some variations, these metal bands may not be used. In some variations, the basket may have handles (not shown) that are attached to the basket walls or molded into the basket walls.

Figure 5A:
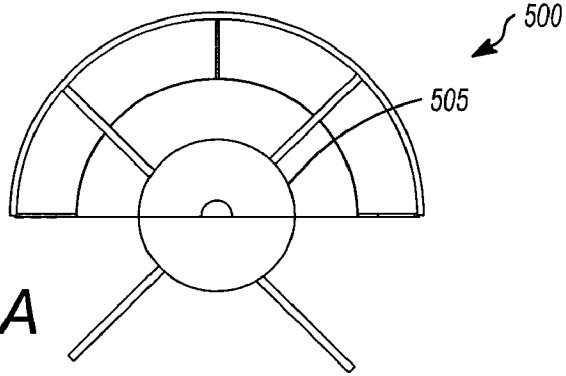
FIG. 5A shows a top view of an exemplary multi-volume basket.
Figure 5B:
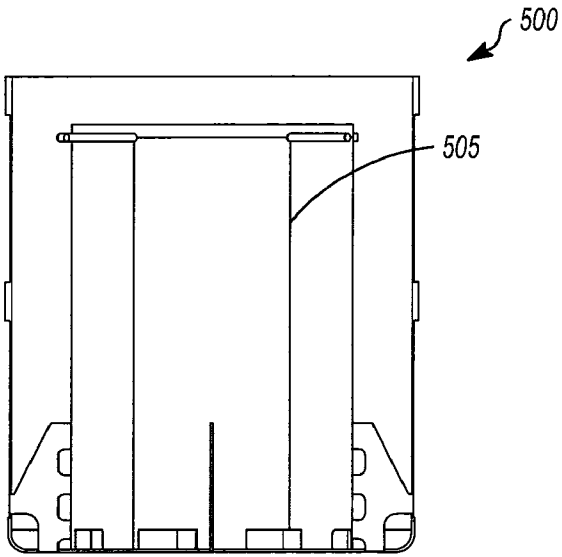
FIG. 5B shows a side view of an exemplary multi-volume basket.
Figure 5C:
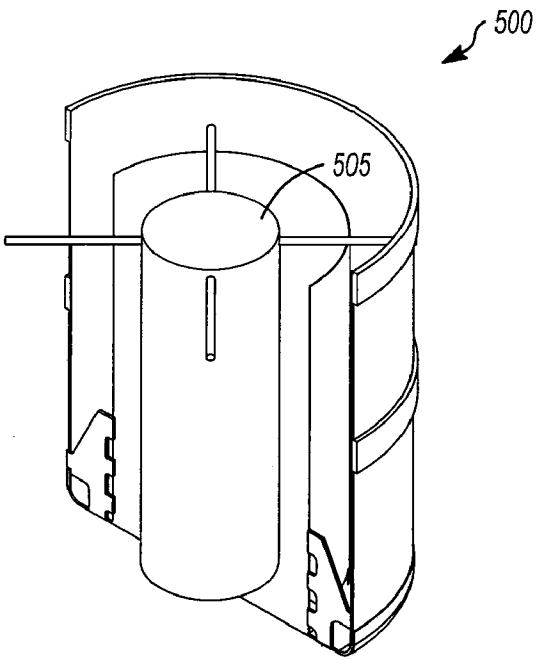
FIG. 5C shows a perspective cutaway view of an exemplary multi-volume basket.
Figure 9:
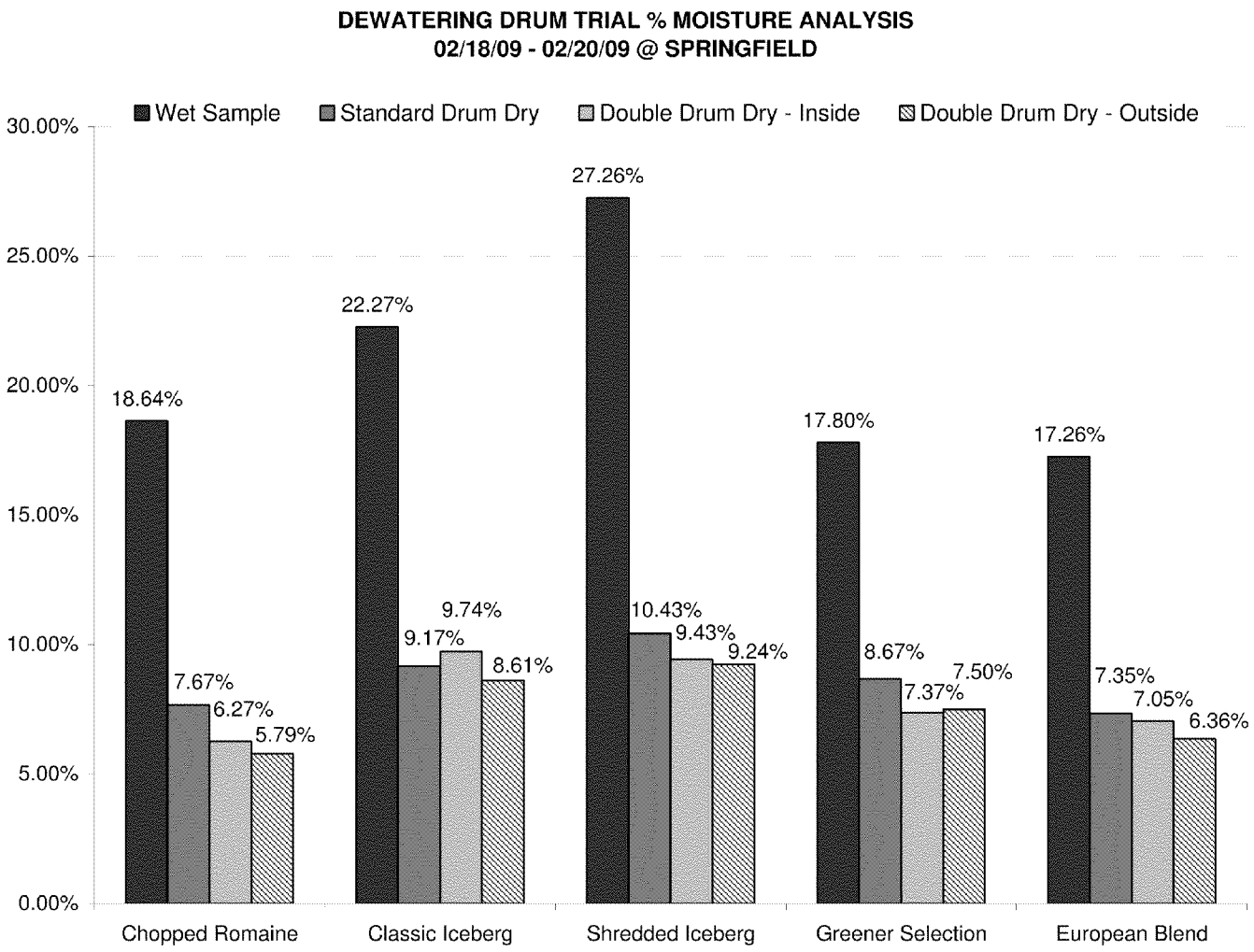
Figure 10:
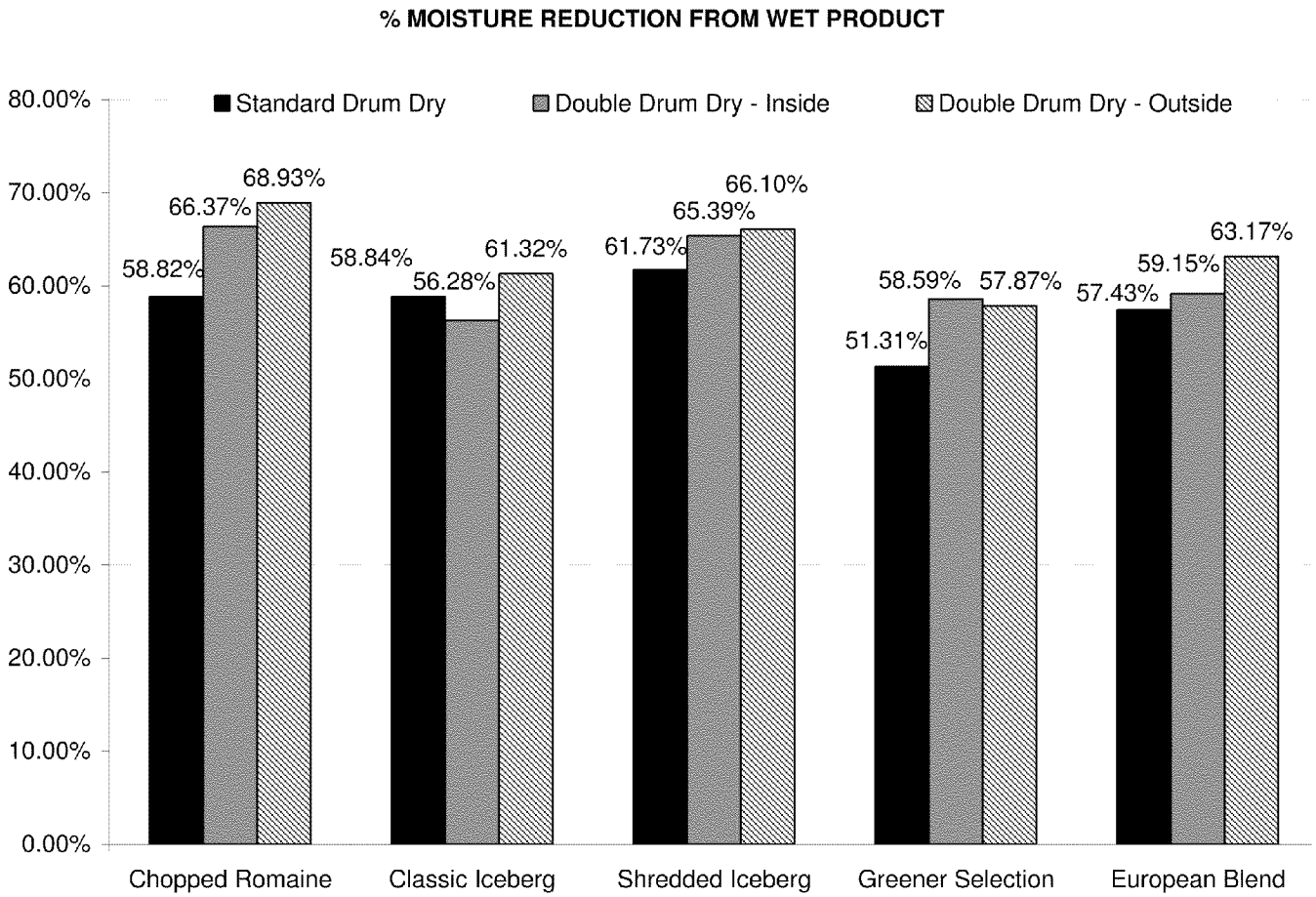

FIGS. 5A, 5B, and 5C show another example of a multi-volume basket 500. The basket 500 is similar to the basket 300 shown in FIGS. 3A, 3B, and 3C, except the first volume is divided into two volumes by a second cylindrical, perforated divider 505 that is oriented concentrically with the walls of the basket.

3. Drying Process

The process set forth herein is typically used to dry produce that has been washed and rinsed yielding wet produce. The wet produce is loaded into a multi-volume basket through the open top. Typically produce is loaded into the first volume, second volume, and third volume of the basket, but in some variations, wet produce may be loaded into only one of the first volume or second volume and may or may not be loaded into the third volume. Loading of the volumes may occur sequentially in any order or contemporaneously. If additional dividers are used as described above, produce may be loaded in the additional volumes defined by the additional dividers.

The basket is placed into the drier so that the basket is seated in the drum of the drier such that rotating the drum will cause rotation of the drier. Produce may be loaded into the basket before and/or after the basket is placed into the drier. Loading produce into the basket and placing the basket into the drum of the drier may be performed manually or by automated equipment or by a combination of manual and automated means.

After the produce is loaded into the basket and the basket is placed in the drier, steps may be taken to evenly distribute the produce with the basket and to break up any clumps of produce in the basket. This may include manually manipulating the produce and/or manually rotating the drum. Also, the motor and drive assembly may be engaged to rotate the drum and the basket for brief intervals in one direction and then the other prior to the spin cycle.

Next, the motor and drive assembly are engaged to for the spin cycle to cause fluids to drain out of the produce toward the perforated walls or bottom of the basket and into the drier housing to yield dried produce.

The duration of a spin cycle generally ranges from 3-20 minutes, during which the rotational speed of the drum and basket generally ranges from 500-700 revolutions per minute. At the end of the spin cycle, the rotation is stopped. One or more additional spin cycles may be performed. The additional spin cycles may be at the same rotational speed, cycle duration, and spin direction, or these parameters may be changed for different spin cycles.

After the desired number of spin cycles has been completed, the basket and produce are removed from the drier. The dried produce may be removed from the basket before or after the basket is removed from the drier.

4. EXAMPLE 1

FIG. 6 summarizes the results of experiments conducted using the process and apparatus set forth herein for drying Romaine lettuce and Spring Mix in a polypropylene multi-volume basket.

Both experiments used freshly harvested and washed Romaine lettuce or Spring Mix vegetables as the starting point. The washed produce was sampled to determine initial moisture content and then dried in a centrifugal drier using either a standard 55-gallon, polypropylene single-volume basket or a multi-volume basket design. The spin cycle times and rotational speeds were the same for all trials. The standard program for plant-made tenderleaf products was used for this experiment. The baskets were sampled after one spin cycle, subjected to an additional spin cycle, and sampled again. In the case of the multi-volume basket design, produce was sampled from both the inner volume (first volume) and the outer volume (second volume). All samples were analyzed for residual moisture using ambient air drying and gravimetric analysis.

The Romaine lettuce was found to have 8.5% surface moisture before being dried. After placing the single-volume basket in the SD-50 drier and completing the two-minute programmed spin cycle, the residual surface moisture was found to be 3.2%. After a second spin cycle, the residual surface moisture was found to be 2.9%. When using the multi-volume basket and the same drying cycle and duration, the residual moisture after one spin cycle of the produce inside the divider (first volume) was found to be 1.2% and the residual moisture of the produce residing between the divider and the walls of the basket (second volume) was found to be 1.9%. Adjusting for their proportional volumes, the overall residual moisture was approximately 1.6%. After a second spin cycle, the produce inside the divider (first volume) was found to be 1.1% and the residual moisture of the produce residing between the divider and the walls of the basket (second volume) was found to be 1.7%. Adjusting for their proportional volumes, the overall residual moisture was approximately 1.4%.

The Spring Mix was found to have 23.5% surface moisture before being dried. After placing the single-volume basket in the SD-50 drier and completing the two-minute programmed spin cycle, the residual surface moisture was found to be 4.9%. After a second spin cycle, the residual surface moisture was found to be 4.5%. When using the multi-volume basket and the same drying cycle and duration, the residual moisture after one spin cycle of the produce inside the divider (first volume) was found to be 2.4% and the residual moisture of the produce residing between the divider and the walls of the basket (second volume) was found to be 2.9%. Adjusting for their proportional volumes, the overall residual moisture was approximately 2.7%. After a second spin cycle, the produce inside the divider (first volume) was found to be 2.3% and the residual moisture of the produce residing between the divider and the walls of the basket (second volume) was found to be 2.7%. Adjusting for their proportional volumes, the overall residual moisture was approximately 2.5%.

The data for both Romaine lettuce and Spring Mix demonstrate significantly improved drying using the same speed and cycle settings with the multi-volume basket compared to the conventional single-volume basket. In both Romaine and Spring Mix, the amounts of water removed were appreciably more using a multi-volume basket compared to a single-volume basket. Appreciably more water removal was observed from Romaine lettuce as compared to Spring Mix due to Romaine's consistent cut size and shape which is less prone to entrain water. Spring Mix retained almost 25% water after the washing process (before drying) as compared to 8.5% for Romaine lettuce.

After drying in the single-volume basket, the Romaine lettuce retained less water (3.2%) when compared to Spring Mix (4.9%). Significant improvement was observed using the multi-volume basket. Use of the multi-volume basket reduced the observed overall residual moisture value by 1.5-2.0% compared to the single-volume basket. The improvement was even more pronounced in Romaine lettuce for which a 2-2.5% reduction of the overall residual moisture value was observed. Overall water removal was always better with Romaine than it was with Spring Mix when compared at each experimental step. Most likely, the more uniform size of the Romaine, as compared to Spring Mix, allowed for better drying.

5. EXAMPLE 2

FIGS. 7A-7D, 8A-8B, 9, and 10 summarize results of experiments conducted using the process and apparatus set forth herein for drying Chopped Romaine, Classic Iceberg, Shredded Iceberg, Greener Selection, and European Blend in a stainless steel, multi-volume basket.

The methodology was similar to that of Example 1 above. For these experiments, stainless steel baskets were tested, a second spin cycle was not used, and spin cycles of varying duration were tested. Freshly harvested and washed produce was used as the starting point. The washed produce was sampled to determine initial moisture content and then dried in a centrifugal drier using a single-volume basket or a multi-volume basket design. The rotational speeds were the same for all trials. The baskets were sampled after one spin cycle. In the case of the multi-volume basket design, produce was sampled from both the inner volume (first volume) and the outer volume (second volume). Three samples were taken from each volume. For each volume, the average residual % moisture and the standard deviation were calculated. All samples were analyzed for residual moisture using ambient air drying and gravimetric analysis.

The Chopped Romaine was observed to have 18.64% surface moisture before being dried. After one drying cycle using a single-volume basket and a 15 minute spin cycle duration, the average residual surface moisture of the samples was observed to be 7.67%. Using the multi-volume basket and the same drying cycle and duration, the average residual moisture of the samples of the produce inside the divider (first volume) was observed to be 6.27% and the average residual moisture of the samples of the produce from between the divider and the walls of the basket (second volume) was observed to be 5.79%. Adjusting for their proportional volumes, the overall residual moisture was approximately 6.00%.

The Classic Iceberg ($1^{st}$ Trial) was observed to have 27.21% surface moisture before being dried. After one drying cycle using a single-volume basket and a 15 minute spin cycle duration, the average residual surface moisture of the samples was observed to be 10.67%. Using the multi-volume basket and the same drying cycle and duration, the average residual moisture of the samples of the produce inside the divider (first volume) was observed to be 11.54% and the average residual moisture of the samples of the produce from between the divider and the walls of the basket (second volume) was observed to be 10.83%. Adjusting for their proportional volumes, the overall residual moisture was approximately 11.14%.

The Classic Iceberg ($2^{nd}$ Trial) was observed to have 22.27% surface moisture before being dried. After one drying cycle using a single-volume basket and a 10 minute spin cycle duration, the average residual surface moisture of the samples was observed to be 9.17%. Using the multi-volume basket and the same drying cycle and duration, the average residual moisture of the samples of the produce inside the divider (first volume) was observed to be 9.74% and the average residual moisture of the samples of the produce from between the divider and the walls of the basket (second volume) was observed to be 8.61%. Adjusting for their proportional volumes, the overall residual moisture was approximately 9.10%.

The Shredded Iceberg was observed to have 27.26% surface moisture before being dried. After one drying cycle using a single-volume basket and a 5 minute spin cycle duration, the average residual surface moisture of the samples was observed to be 10.43%. Using the multi-volume basket and the same drying cycle and duration, the average residual moisture of the samples of the produce inside the divider (first volume) was observed to be 9.43% and the average residual moisture of the samples of the produce from between the divider and the walls of the basket (second volume) was observed to be 9.24%. Adjusting for their proportional volumes, the overall residual moisture was approximately 9.32%.

The Coleslaw was observed to have 30.83% surface moisture before being dried. After one drying cycle using a single-volume basket and 10 minute spin cycle duration, the average residual surface moisture of the samples was observed to be 15.69%. Using the multi-volume basket and the same drying cycle and duration, the average residual moisture of the samples of the produce inside the divider (first volume) was observed to be 15.72% and the average residual moisture of the samples of the produce from between the divider and the walls of the basket (second volume) was observed to be 16.36%. Adjusting for their proportional volumes, the overall residual moisture was approximately 16.08%.

The European Blend was observed to have 17.26% surface moisture before being dried. After one drying cycle using a single-volume basket and a 10 minute spin cycle duration, the average residual surface moisture of the samples was observed to be 7.35%. Using the multi-volume basket and the same drying cycle and duration, the average residual moisture of the samples of the produce inside the divider (first volume) was observed to be 7.05% and the average residual moisture of the samples of the produce from between the divider and the walls of the basket (second volume) was observed to be 6.36%. Adjusting for their proportional volumes, the overall residual moisture was approximately 6.66%.

The Greener Selection was observed to have 17.80% surface moisture before being dried. After one drying cycle using a single-volume basket and 10 minute spin cycle duration, the average residual surface moisture of the samples was observed to be 8.67%. Using the multi-volume basket and the same drying cycle and duration, the average residual moisture of the samples of the produce inside the divider (first volume) was observed to be 7.37% and the average residual moisture of the samples of the produce from between the divider and the walls of the basket (second volume) was observed to be 7.50%. Adjusting for their proportional volumes, the overall residual moisture was approximately 7.44%.

The data demonstrate improved drying of all of the varieties of produce that were tested using the multi-volume basket as compared to the single-volume basket, at the same speed and cycle settings. For all products, the amount of water removed was appreciably greater using the multi-volume basket as compared to the single-volume basket.

We claim:

1. A commercial method of drying produce in a centrifugal drier comprising a housing and a drum, the method comprising:

loading the produce into a first volume of a multi-volume basket, wherein the basket has perforated walls defining the sides of the basket, a closed lower end, and an open upper end, wherein the interior volume of the basket is divided into a first volume and a second volume by a perforated inner divider that is oriented concentrically to the walls defining the sides of the basket, wherein support rods connect the perforated inner divider to the perforated walls of the basket, and wherein the first volume is disposed inside the inner divider and includes the center of the basket;

loading the produce into a second volume of a multi-volume basket, wherein the second volume is disposed between the inner divider and the walls defining the sides of the basket; and rotating the drum and thereby rotating the basket, loaded with produce in the first and second volumes, to cause fluids to drain out of the produce toward the perforated walls or bottom of the basket and into the drier housing to yield dried produce.

2. The method of claim 1, further comprising:

placing the basket, loaded with produce in the first and second volumes, into the drier so that the basket is seated in the drum of the drier such that rotating the drum will cause rotation of the basket.

3. The method of claim 1, further comprising:
removing the basket from the drier; and
removing the dried produce from the basket.

4. The method of claim 1, wherein the produce is loaded into a third volume of the basket, wherein the third volume is defined by the basket walls, the horizontal plane defining the top of the basket, and the horizontal plane defining the top of the inner divider.

5. The method of claim 1, wherein the ratio of the height of the inner divider to the height of the walls is in the range of 50-100%.

6. The method of claim 5, wherein the ratio of the height of the inner divider to the height of the walls is 90%.

7. The method of claim 1, wherein the inner divider is a cylinder and the diameter of the inner divider ranges from 20-80% of the diameter of the walls of the basket.

8. The method of claim 7, wherein the diameter of the inner divider is 70% of the diameter of the walls of the basket.

9. The method of claim 1, wherein the first volume ranges from 25-85% of the volume of the entire volume basket.

10. The method of claim 9, wherein the first volume ranges from 30-60% of the volume of the entire volume basket.

11. The method of claim 10, wherein the first volume is 45% of the volume of the entire volume basket.

12. The method of claim 1, wherein the first volume is divided by a second inner divider, which is oriented concentrically to the inner divider.

13. The method of claim 1, wherein the produce is selected from the group consisting of romaine lettuce, iceberg lettuce, coleslaw, red leaf lettuce, radicchio, frisee, carrots, and cabbage.

14. The method of claim 1, wherein the rotational speed is in the range of 500-700 revolutions per minute.

15. The method of claim 1, wherein the duration of a spin cycle ranges from 3-20 minutes.

16. The method of claim 1, wherein more than one spin cycle is performed.

17. The method of claim 1, wherein the basket comprises a material selected from metal, plastic, composite, or any combination thereof.

18. The method of claim 1, wherein the produce loaded into the first volume of the multi-volume basket is the same as the produce loaded into the second volume of the multi-volume basket.

* * * * *